United States Patent [19]

Parsons

[11] 4,194,457

[45] Mar. 25, 1980

[54] TUFTING MACHINE NEEDLES

[75] Inventor: Ronald Parsons, Blackburn, England

[73] Assignee: Spencer Wright Industries, Inc., Chattanooga, Tenn.

[21] Appl. No.: 963,093

[22] Filed: Nov. 22, 1978

[51] Int. Cl.[2] ..... D05B 85/00; D05C 15/00

[52] U.S. Cl. ..... 112/222; 112/79 R

[58] Field of Search ..... 112/79 R, 222, 80

[56] References Cited

U.S. PATENT DOCUMENTS

| | | | |
|---|---|---|---|
| 1,924,715 | 8/1933 | Farrell | 112/79 R |
| 3,469,348 | 9/1969 | Zocher | 112/222 |
| 3,485,195 | 12/1969 | Torrence | 112/79 R X |
| 3,618,542 | 11/1971 | Zocher | 112/79 R |
| 3,929,082 | 12/1975 | Zocher | 112/222 |
| 3,954,072 | 5/1976 | Zocher | 112/222 |
| 4,138,956 | 2/1978 | Parsons | 112/79 R X |

*Primary Examiner*—Ronald Feldbaum

*Attorney, Agent, or Firm*—Alan Ruderman

[57] ABSTRACT

A tufting needle for use in a module having a generally flat elongate element including a yarn receiving eye adjacent one end and an enlargement at the other end with the needle having a small twist between the ends.

2 Claims, 2 Drawing Figures

TUFTING MACHINE NEEDLES

The invention concerns tufting machine needles, and has particular reference to a needle of application in the context of needle modules for use in tufting machines.

In our co-pending U.S. patent application Ser. No. 907,551 now U.S. Pat. No. 4,138,956 there is described and illustrated a needle module for the needle arrangement of a tufting machine which comprises a body part adapted to be attached to the needle bar of the said tufting machine and having a plurality of needles formed integrally therewith to depend in spaced parallel, side-by-side disposition therefrom, the length of the module being equal to or substantially equal to a multiple of the pitch of the needles supported by such module and the number of needles being equal to such multiple.

The object of the present invention is to provide a needle of particular use in the production of such a needle module.

According to the present invention, there is proposed a needle for a tufting machine, and in particular for a needle module for a tufting machine needle arrangement, which comprises a generally flat elongate element having a yarn receiving eye adjacent one end thereof, a first region of non-uniform cross-sectional from within that longitudinal extend of the needle intended for location within the body part of the module, being a part of the element remote from the said eye, a pick-up area adjacent the eye, and a second region having, in at least one direction, a predetermined transverse dimension and being located intermediate the said first region and the said pick-up area, the said element being twisted intermediate the said second region and pick-up area to provide a set whereby that part of the element which provides the pick-up area lies in a plane inclined at a small angle relative to the plane of the remainder of the element.

Preferably that part of the element which provides the pick-up area lies at an angle of approximately 6° with respect to the remainder of the element.

The invention will now be described further, by way of example only, with reference to the drawing filed with the Provisional Specification which illustrates one embodiment thereof, and in which.

Figure 1:
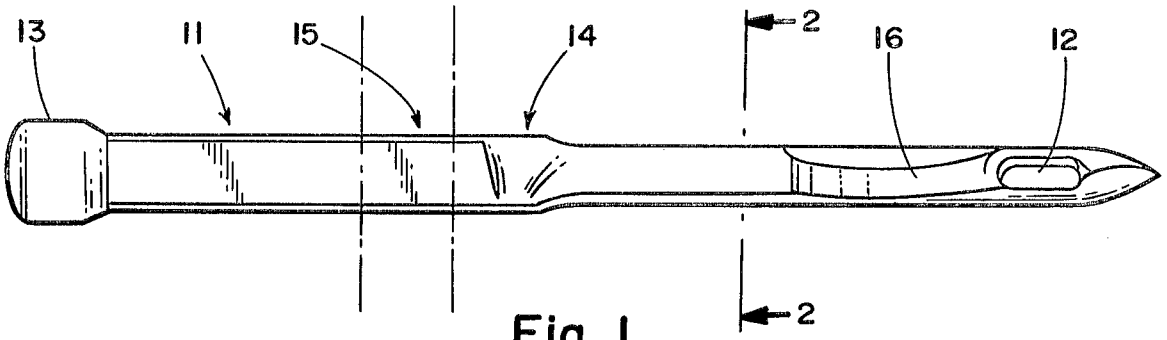
FIG. 1 is a plan view of a needle in accordance with the invention.
Figure 2:
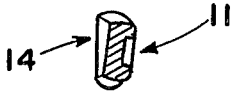
FIG. 2 is a section on line X—X of FIG. 1.

Referring now to the drawing, a needle for incorporation in a needle module for the needle arrangement of a tufting machine comprises a flat elongate element 11 having an eye 12 adjacent one end and an enlargement 13 at the opposite end of the said element, the element being twisted at a position, indicated at 14, approximately mid-way between its ends to introduce a "set" whereby the plane of that part of the element wherein the pick-up area is formed is inclined in relation to the plane of the remainder of the element at an angle of approximately 6°.

The element 11 is approximately 1.875 inches long, 0.1 inches wide and 0.05 inches thick, the enlargement 13 extending over a distance of approximately 0.125 inches in the axial direction of the element and arising from a flattening of the end of the element to increase the width and reduce the thickness of such element in such region.

At a position approximately 0.875 inches from the enlarged end of the element the same is twisted, as at 14, to provide the 6° set before referred to, the transverse dimensions of the element in closely spaced disposition relative to the region of twist and at that side thereof remote from the needle eye 12 being maintained to predetermined tolerances over a longitudinal extent of, say, 0.3125 inches to provide a location means 15 for use in accurately positioning the element in a suitable tool (not shown) during the subsequent moulding or casting operation in the formation of the ultimate needle module.

The surface of the element is ground adjacent to the eye, as at 16, in order to provide an increased target area on the needle for engagement by the looper.

By providing a needle in the form hereinproposed we are able readily to introduce any "set" appropriate to the specific requirements of the tufting machine by a simple twisting operation, which set is reproduced in the module on inclusion of the needle therein by utilisation of the location means in setting up the needles as a preliminary to casting or moulding.

A further, and important, advantage lies in the possibility, with needle shanks of the flattened form herein proposed, of arranging the needle in position within a matrix in spaced disposition relative to other like needles in the manner proposed in our co-pending Application aforesaid at greater separation for a given needle pitch than is the case with conventional needles having cylindrical shanks of like strength, thereby to provide for the ready movement of metal between adjacent shanks and an increased strength in the matrix. Thus, the need to utilize reduced diameter shanks, with a resultant diminution in shank strength so as to ensure adequate strength in the matrix is avoided, this being particularly important in small gauge situations.

Whilst the embodiment described and illustrated is produced from stock rod or bar of circular section using conventional die pressing and/or grinding techniques, alternative starting elements may be used if preferred, and in this regard a stock strip material may be of application.

The invention is not restricted in the exact details of the embodiment hereindisclosed, since alternatives will readily present themselves to one skilled in the art. Thus, for example, the enlargement may take any form other than that shown which will preclude withdrawal of the needle from the body part of the module in the axial direction of such needle, rotation of the needle in such body part being prevented by the non-circular character of the shank of such needle.

Having thus set forth the nature of the invention, what is claimed herein is:

1. A needle for embedding within the body of a tufting machine needle module comprising a generally flat elongated element having a point at one end thereof and a yarn receiving eye adjacent said point, said element having a width greater than its thickness, said eye comprising an aperture extending transversely through the surfaces defining the thickness, a first region on non-uniform cross-sectional form within that longitudinal extent of the needle remote from the point intended for location within the body of the module, said first region comprising a localized region of increased width and reduced thickness relative to the transverse dimensions of an adjacent part of the elongate element, a pick-up area adjacent the eye, and a second region having, in at least one direction, a locating means defined by a predetermined transverse dimension intermediate the first region and the said pick-up area, said first and second regions lying substantially in the same plane, the said element being twisted intermediate the second region and the pick-up area to provide a set whereby that part of the element which provides the pick-up area lies in a plane inclined at a small acute angle relative to the plane of the first and second regions.

2. A needle as recited in claim 1, wherein that part of the element which provides the pick-up area lies in a plane inclined at an angle approximately 6° with respect to the first and second regions.

* * * * *